US007495616B2

(12) United States Patent
Tang et al.

(10) Patent No.: US 7,495,616 B2
(45) Date of Patent: Feb. 24, 2009

(54) OMNIDIRECTIONAL ULTRA-WIDEBAND MONOPOLE ANTENNA

(75) Inventors: Chia-Lun Tang, Hsinchu (TW); Shih-Hung Yeh, Hsinchu (TW); Kin-Lu Wong, Hsinchu (TW); Saou-Wen Su, Hsinchu (TW); Chih-Hsien Wu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/034,792

(22) Filed: Jan. 14, 2005

(65) Prior Publication Data

US 2006/0071871 A1 Apr. 6, 2006

(30) Foreign Application Priority Data

Oct. 5, 2004 (TW) ..... 93130145 A

(51) Int. Cl.
*H01Q 1/38* (2006.01)

(52) U.S. Cl. ..... 343/700 MS

(58) Field of Classification Search ..... 343/700 MS, 343/829, 702, 830

See application file for complete search history.

(56) References Cited

U.S. PATENT DOCUMENTS

| | | | | |
|---|---|---|---|---|
| 4,396,920 | A * | 8/1983 | Grimberg et al. | 343/846 |
| 4,466,003 | A | 8/1984 | Royce | |
| 4,931,806 | A * | 6/1990 | Wunderlich | 343/715 |
| 5,644,319 | A * | 7/1997 | Chen et al. | 343/702 |
| 5,734,350 | A * | 3/1998 | Deming et al. | 343/700 MS |
| 5,828,340 | A | 10/1998 | Johnson | |
| 5,886,669 | A * | 3/1999 | Kita | 343/718 |
| 6,313,798 | B1 * | 11/2001 | Bancroft et al. | 343/700 MS |
| 6,339,409 | B1 | 1/2002 | Warnagiris | |
| 6,441,791 | B1 * | 8/2002 | Oka | 343/713 |
| 6,784,369 | B2 * | 8/2004 | Song et al. | 174/78 |
| 7,079,077 | B2 * | 7/2006 | Lee | 343/700 MS |
| 2002/0047810 | A1 * | 4/2002 | Chatzipetros et al. | 343/713 |
| 2003/0222823 | A1 * | 12/2003 | Flint et al. | 343/702 |
| 2005/0243009 | A1 * | 11/2005 | Wong et al. | 343/829 |

OTHER PUBLICATIONS

Ammann et al., "Wideband Monopole Antennas for Multi-Band Wireless Systems", IEEE Antennas and Propagation Magazine, vol. 45, No. 2, Apr. 2003, pp. 146-150.

* cited by examiner

*Primary Examiner*—Huedung Mancuso
(74) *Attorney, Agent, or Firm*—Birch, Stewart, Kolasch & Birch, LLP

(57) ABSTRACT

An omnidirectional ultra-wideband monopole antenna, with the characteristics of simple structure, easy fabrication and low cost, mainly comprises a ground plane, a U-shaped radiating member above the ground plane and a feeding member for feeding signals to the radiating member. The radiating member further comprises a first sub-radiating member parallel to the ground plane, with a first side edge and a corresponding second side edge, a second sub-radiating member connected to the first side edge and perpendicular to the first sub-radiating member, forming a first angle therebetween, and a third sub-radiating member connected to the second side edge to form a second angle. The second sub-radiating member and the third sub-radiating member are extended in the same upright direction above the ground plane. The antenna can provide good omnidirectional radiation patterns for frequencies across a very wide operating bandwidth.

22 Claims, 8 Drawing Sheets x-z plane x-y plane y-z plane x-z plane x-y plane y-z plane

OMNIDIRECTIONAL ULTRA-WIDEBAND MONOPOLE ANTENNA

BACKGROUND OF THE INVENTION

1. Field of Invention

The invention relates to an ultra-wideband monopole antenna structure and, in particular, to an omnidirectional ultra-wideband monopole antenna that provides good omnidirectional radiation patterns for frequencies across a very wide operating bandwidth.

2. Related Art

With the continuous development and advance of digital audio/video (AV) and mobile communications in wireless local area network (WLAN), there have been demands for higher data transmission rate.

The IEEE 802.15 WPAN (Wireless Personal Area Network) put forward by the Institute of Electrical and Electronics Engineers is a standard for ultra-wideband operation with a high data transmission rate. For practical design considerations of the antennas for such an ultra-wideband operation, in addition to providing a wide operating bandwidth with a frequency ratio over 1:3, the antenna has to maintain stable omnidirectional radiation patterns over its operating bandwidth to achieve wide coverage and good communication performances. Thus, whether the ultra-wideband antenna can provide the required stable and omnidirectional patterns over the operating bandwidth is the main factor that determines whether the antenna structure is suitable for practical applications.

Among the currently known ultra-wideband antenna structures, the planar metal-plate monopole antenna has the highest application values. Although this type of antennas can provide an ultra-wide operating bandwidth, their radiation stability and omnidirectional property become worse as the operating frequency increases. Therefore, they cannot satisfy practical needs.

To improve the omnidirectional radiation patterns, the U.S. Pat. No. 6,339,409 discloses a thin, long cylinder structure for the antenna. A rectangular metal plate is coiled into a spiral shape to control the radiation patterns produced by the antenna, thereby satisfying the omnidirectional requirement. However, the drawback of this structure is its complicated structure, which makes good yield difficult to obtain.

Another known wideband antenna structure, such as the one disclosed in the U.S. Pat. No. 4,466,003, makes use of a combination of metal rod with different lengths. Although such a structure can generate many different resonant frequencies, its drawback is also its complicated structure and high production cost. The whole antenna is too large in size. The antenna structure disclosed in the U.S. Pat. No. 5,828,340 cannot satisfy the requirement of omnidirectional radiation patterns and provide a sufficiently wide operating bandwidth.

Therefore, how to design an antenna structure with an ultra-wide operating bandwidth, omnidirectional radiation patterns, and with the characteristics of simple structure, easy fabrication, and low cost is the most important research direction in the field of ultra-wideband monopole antennas.

SUMMARY OF THE INVENTION

In view of the foregoing, the invention provides an omnidirectional ultra-wideband monopole antenna, which not only provides an ultra-wide operating bandwidth (with a range between 2.0 GHz and 7.1 GHz and a frequency ratio greater than 1:3) but also satisfies the requirement of omnidirectional radiation patterns.

Its primary structure includes: (1) a ground plane; (2) a U-shaped radiating member above the ground plane; and (3) a feeding member for feeding signals to the radiating member.

The radiating member further includes: a first sub-radiating member parallel to the ground plane, with a first side edge and a corresponding second side edge; a second sub-radiating member connected to the first side edge and perpendicular to the first sub-radiating member, forming a first angle therebetween; and a third sub-radiating member connected to the second side edge to form a second angle. The second sub-radiating member and the third sub-radiating member are extended in the same upright direction above the ground plane.

Aside from adjusting the length ratio of two adjacent side edges of the first sub-radiating member to tune the input impedance of the antenna, the invention further adjusts the distance between the first sub-radiating member and the ground plane to achieve an enhanced impedance matching for frequencies across the desired ultra-wideband operation.

Using this antenna structure can control the gain variation of the azimuthal radiation pattern less than 3 dB for all frequencies across a very wide operating bandwidth. That is, the invention can provide good omnidirectional radiation patterns.

The disclosed omnidirectional ultra-wideband monopole antenna has the characteristics of simple structure, easy fabrication, high yield, and low cost.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
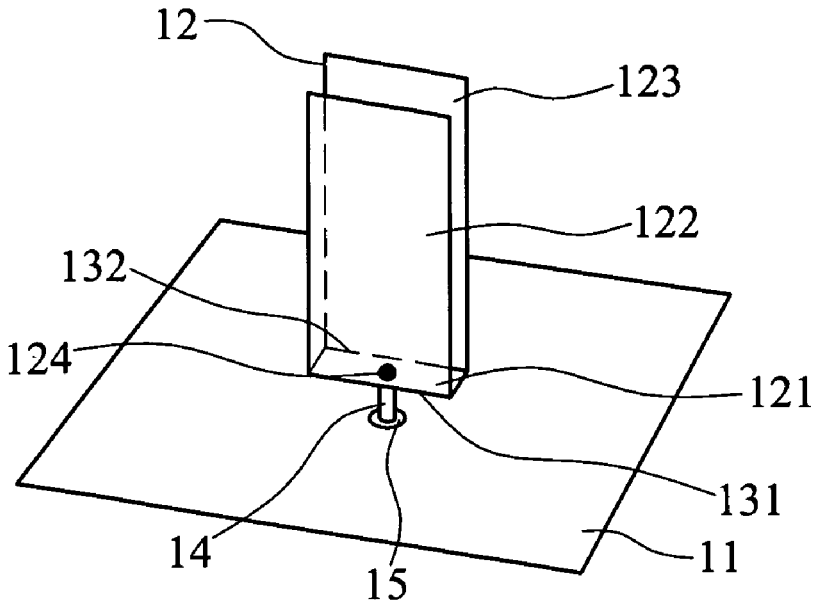
FIG. 1A shows a three-dimensional view of the invention.
Figure 1B:
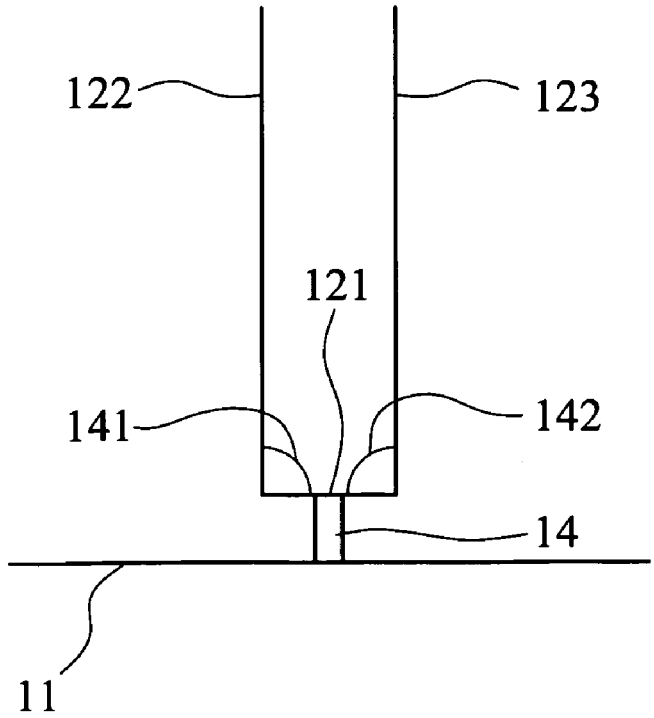
FIG. 1B shows a side view of the invention.

The disclosed omnidirectional ultra-wideband monopole antenna, as shown in FIGS. 1A and 1B, mainly includes: a ground plane 11, a radiating member 12, and a feeding member 14.

The radiating member 12 is U-shaped and installed above the ground plane 11. It includes a first sub-radiating member 121 parallel to the ground plane 11, with a first side edge 131 and a corresponding second side edge 132, a second sub-radiating member 122 connected to the first side edge 131 and perpendicular to the first sub-radiating member 121, forming a first angle 141 between them, and a third sub-radiating member 123 connected to the second side edge 132 and perpendicular to the first sub-radiating member 121, forming a second angle 142 between them. The second sub-radiating member 122 and the third sub-radiating member 123 are extended in the same upright direction above the ground plane.

The feeding member 14 receives signals from an external signal source (not shown) through electrical connections and feeds the signals to the radiating member 12, making the antenna generate the required wide operating bandwidth.

The commonly seen structure of the ground plane 11, the radiating member 12, and the feeding member 14 is shown in FIG. 1A. The feeding member 14 is located between the ground plane 11 and the radiating member 12, with its one end passing through a via-hole 15 of the ground plane 11 to form an electrical connection with the external signal source to receive signals and its other end connected with the feeding point 124 of the radiating member 12 for transmitting and feeding signals to the radiating member 12. Usually, the feeding point 124 is located at about the center of the first sub-radiating member 121.

Figure 2A:
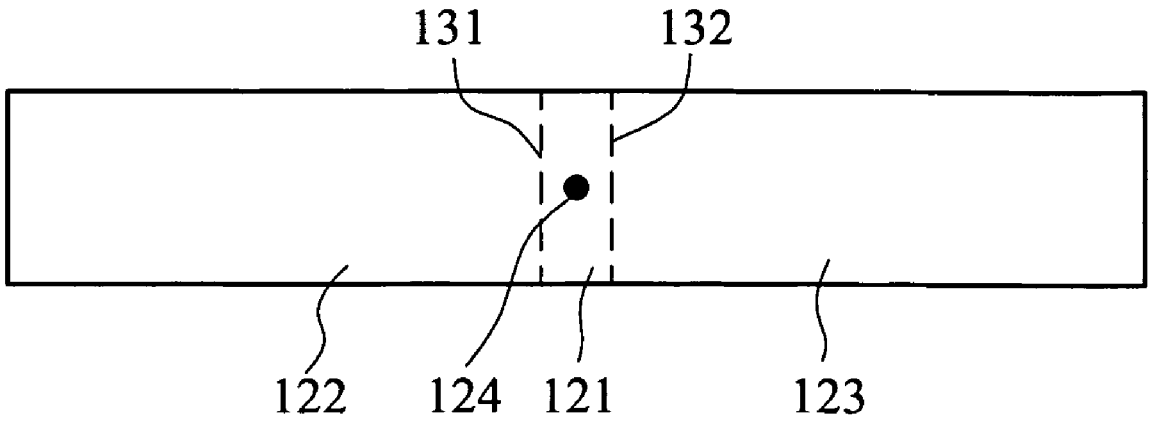
FIG. 2A shows an unbent planar structure of the disclosed radiating member.
Figure 2B:
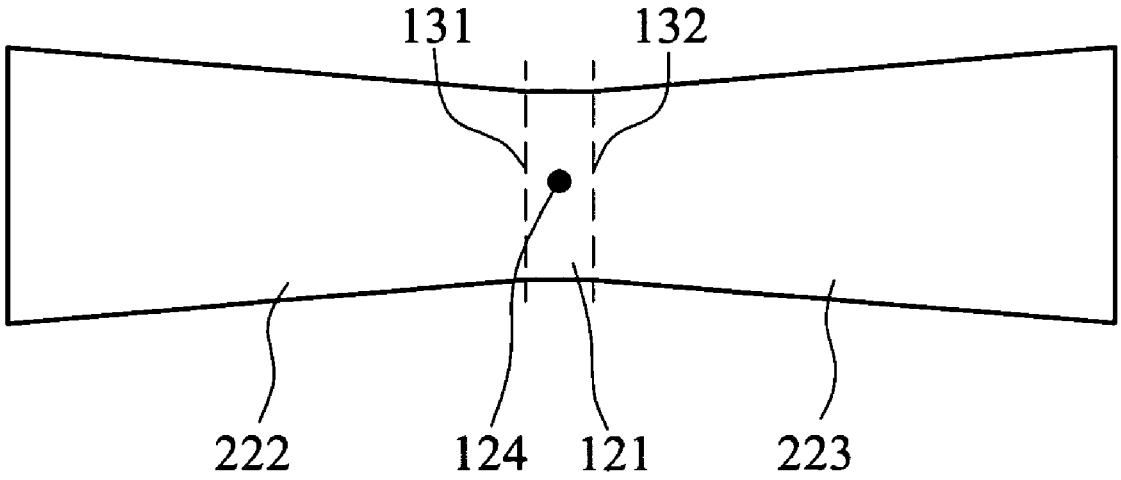
FIG. 2B shows an unbent planar structure of another radiating member.
Figure 2C:
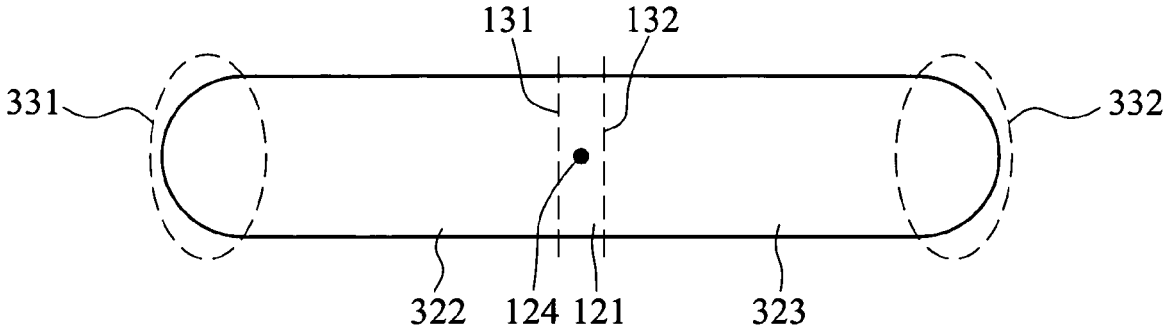
FIG. 2C shows an unbent planar structure of yet another radiating member.

The unbent planar structure of the radiating member 12 is shown in FIG. 2A. Normally, the first sub-radiating member 121, the second sub-radiating member 122, and the third sub-radiating member 123 can be formed by bending a single metal plate or from a combination of at least two metal plates. The second sub-radiating member 122 and the third sub-radiating member 123 have similar shapes. They can be rectangular plates (such as those in FIG. 2A), trapezoid plates (such as those in FIG. 2B), or those in FIG. 2C where the upright extensions are round at the first end 331 and the second end 332.

To provide good omnidirectional radiation in the azimuthal plane, the widths of the second sub-radiating member 122 and the third sub-radiating member 123 are roughly smaller than ¾ wavelength of the required highest operating frequency. The first angle 141 and the second angle 142 (see FIG. 1B) are maintained the same (about 90 degrees; that is, the second sub-radiating member 122 and the third sub-radiating member 123 are roughly parallel to each other).

To obtain good impedance matching, the length ratio of two adjacent side edges of the first sub-radiating member 121 is preferably greater than 2. By adjusting the distance between the first sub-radiating member 121 and the ground plane 11, the impedance matching can be further improved so that the disclosed omnidirectional ultra-wideband monopole antenna can readily obtain good impedance matching over a wide frequency range.

In the following, a preferred embodiment of the invention is constructed and tested.

In the preferred embodiment, we select the following dimensions for the constructed prototype. The side length of the ground plane 11 is about 100 mm. The two adjacent side edges of the first sub-radiating member 121 of the radiating member 12 are respectively 11 mm and 4 mm. The two adjacent side edges of the second sub-radiating member 122 and the third sub-radiating member 123 are respectively 25 mm and 11 mm. The distance between the first sub-radiating member 121 and the ground plane 11 is 4 mm.

Figure 3:
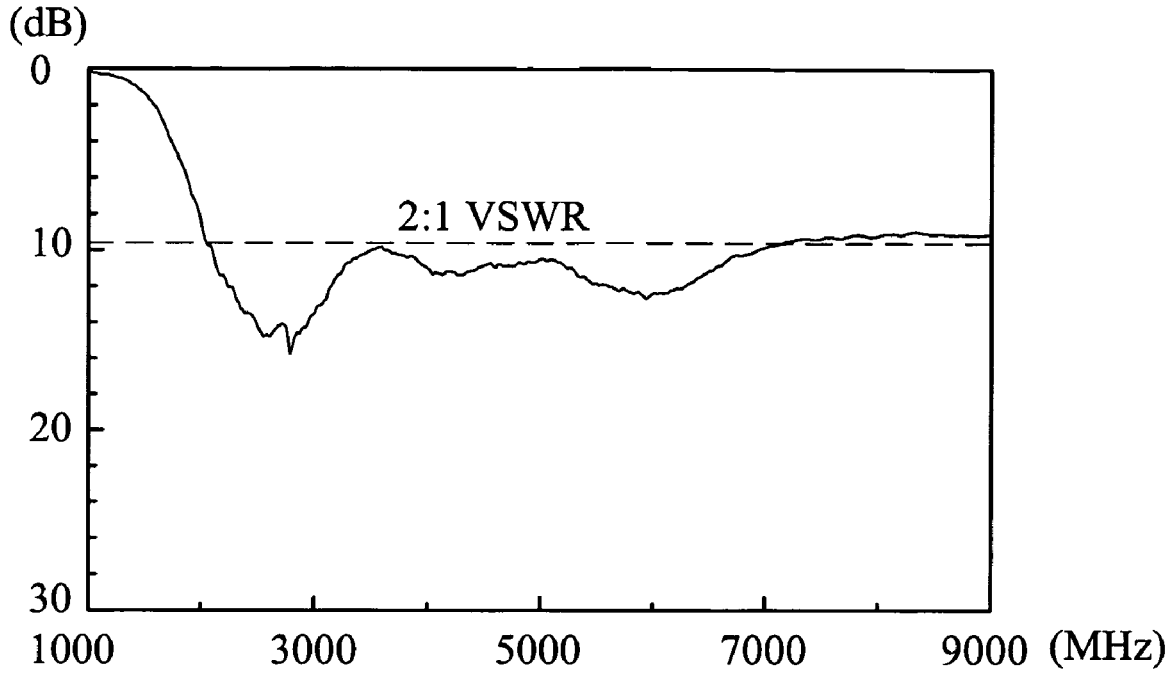
FIG. 3 shows the measured return loss for a preferred embodiment of the invention.
Figure 4A:
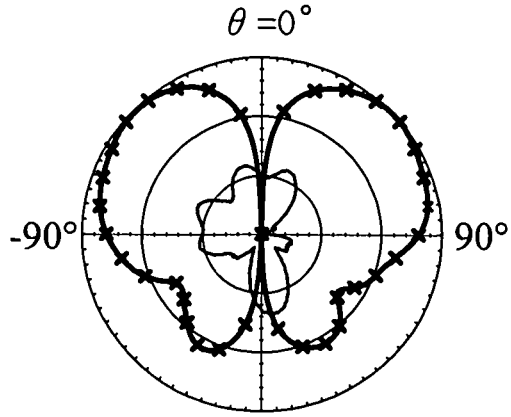
FIGS. 4A to 4C shows the measured radiation patterns of the preferred embodiment operating at 3.0 GHz.
Figure 4B:
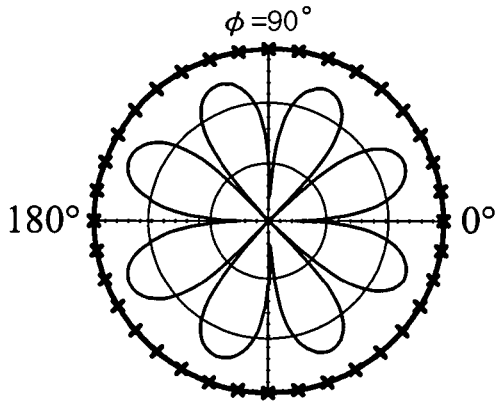
Figure 4C:
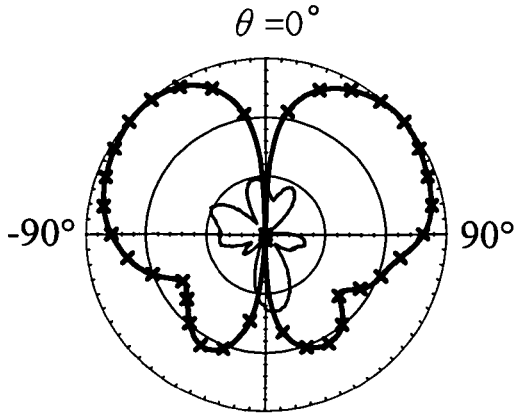
Figure 4D:
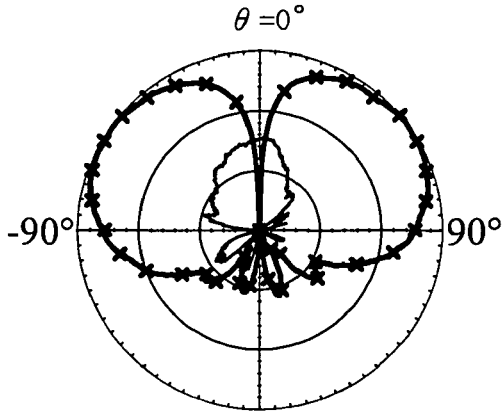
FIGS. 4D to 4F shows the measured radiation patterns of the preferred embodiment operating at 6.0 GHz.
Figure 4E:
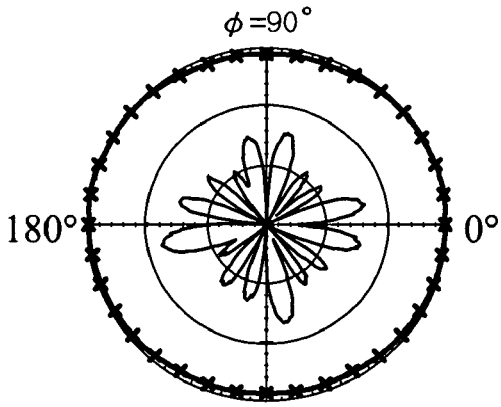
Figure 4F:
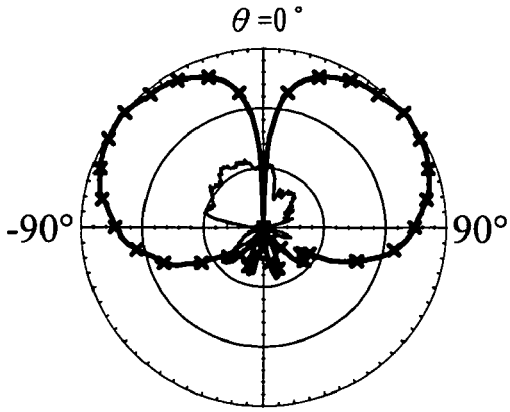

FIG. 3 shows the measured return loss of the preferred embodiment (the vertical axis is the return loss and the horizontal axis is the operating frequency). From the measured results we see that with the definition of 2:1 voltage standing-wave ratio (VSWR), the embodiment has a satisfactory ultra-wide operating bandwidth covering 2.0 GHz to 7.1 GHz (the frequency ratio is greater than 1:3).

FIGS. 4A~4C and 4D~4F show the radiation patterns measured at 3.0 GHz and 6.0 GHz. One can see that good monopole-like radiation patterns in the elevation planes (x-z and y-z planes) at either 3.0 GHz or 6.0 GHz are obtained. The measurement in the azimuthal plane (x-y plane) shows that the gain variation is less than 3 dB. Apparently, the preferred embodiment of the invention can achieve good omnidirectional radiation patterns. In particular, good radiation patterns are also obtained for higher operating frequencies FIGS. 5A and 5B show respectively the measured antenna gain and gain variations of the azimuthal radiation patterns over the operating bandwidth.

Figure 5A:
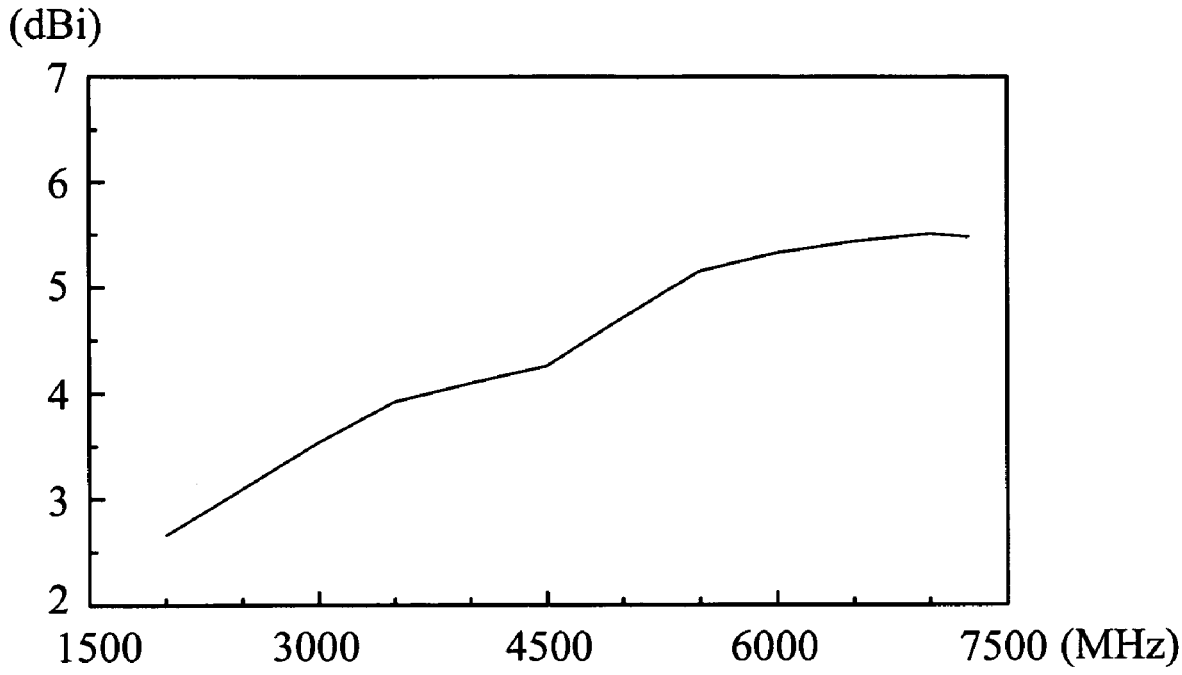
FIG. 5A shows the measured antenna gain in the operating band of the preferred embodiment.

In FIG. 5A, the vertical axis is the antenna gain and the horizontal axis is the operating frequency. It is seen that the antenna gain of the preferred embodiment is between 2.7 and 5.5 dBi over the operating bandwidth (2.0 GHz to 7.1 GHz). This satisfies the gain requirement for practical WLAN applications.

Figure 5B:
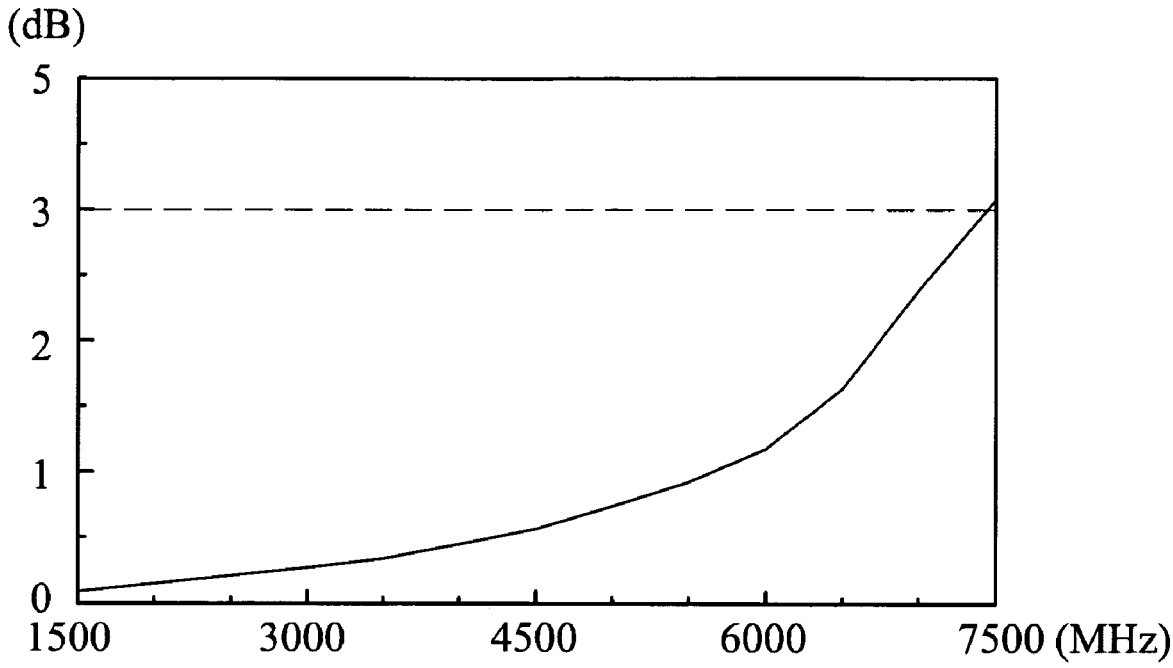
FIG. 5B shows the measured antenna gain variation in the azimuthal radiation pattern over the operating band of the preferred embodiment.

In FIG. 5B, the vertical axis is the gain variation and the horizontal axis is the operating frequency. It is seen that the preferred embodiment can keep the gain variation less than 3 dB over the operating bandwidth. Apparently, the invention has a high stability in the radiation patterns.

From the above description, we know that the disclosed omnidirectional ultra-wideband monopole antenna indeed can obtain an ultra-wide operating bandwidth with good impedance matching. More importantly, the gain variation of the radiation patterns can be maintained less than 3 dB across the operating band. Thus, the invention has good omnidirectional radiation patterns. Moreover, the disclosed omnidirectional ultra-wideband monopole antenna has the characteristics of simple structure, easy fabrication, high yield, and low cost.

Certain variations would be apparent to those skilled in the art, which variations are considered within the spirit and scope of the claimed invention.

What is claimed is:

1. An omnidirectional ultra-wideband monopole antenna, comprising:

a ground plane;

a radiating member, installed above the ground plane, the radiating member comprising:

a first sub-radiating member, parallel to the ground plane and having a first side edge and a corresponding second side edge;

a second sub-radiating member, one end of the second sub-radiating member connected to the first side edge of the first sub-radiating member, another end of the second sub-radiating member not connected to any other element and extended in the upright direction above the ground plane, such that a first angle is formed between the second sub-radiating member and the first sub-radiating member; and a third sub-radiating member, one end of the third sub-radiating member connected to the second side edge of the first sub-radiating member, another end of the third sub-radiating member not connected to any other element and extended in the upright direction above the ground plane, such that a first angle is formed between the third sub-radiating member and the first sub-radiating member, wherein the second sub-radiating member resides entirely within a first plane, and the third sub-radiating member resides entirely within a second plane; and a feeding member, which receives a signal from a signal source through an electrical connection and feeds the signal to the radiating member.

2. The omnidirectional ultra-wideband monopole antenna of claim 1, wherein the ground plane has a via-hole for the feeding member to feed the signal into the radiating member.

3. The omnidirectional ultra-wideband monopole antenna of claim 1, wherein the first sub-radiating member includes a feeding point for the feeding member to connect and transmit the signal.

4. The omnidirectional ultra-wideband monopole antenna of claim 3, wherein the feeding point is installed at about the center of the first sub-radiating member.

5. The omnidirectional ultra-wideband monopole antenna of claim 1, wherein the first sub-radiating member is rectangular with the length ratio of its two adjacent sides greater than 2.

6. The omnidirectional ultra-wideband monopole antenna of claim 1, wherein the first sub-radiating member, the second sub-radiating member, and the third sub-radiating member are formed by bending a metal plate.

7. The omnidirectional ultra-wideband monopole antenna of claim 1, wherein the first sub-radiating member, the second sub-radiating member, and the third sub- radiating member comprise at least two metal plates.

8. The omnidirectional ultra-wideband monopole antenna of claim 1, wherein the second sub-radiating member and the third sub-radiating member have similar shapes.

9. The omnidirectional ultra-wideband monopole antenna of claim 1, wherein the second sub-radiating member and the third sub-radiating member are rectangular plates.

10. The omnidirectional ultra-wideband monopole antenna of claim 1, wherein the second sub-radiating member and the third sub-radiating member are trapezoid plates.

11. The omnidirectional ultra-wideband monopole antenna of claim 1, wherein the extended ends of the second sub-radiating member and the third sub- radiating member are of round shape.

12. The omnidirectional ultra-wideband monopole antenna of claim 1, wherein the first angle and the second angle are the same and equal to about 90 degrees.

13. The omnidirectional ultra-wideband monopole antenna of claim 1, wherein a distance from the first sub-radiating member to the ground plane is adjustable to adjust an impedance matching of the omnidirectional ultra-wideband monopole antenna over a wide frequency range.

14. The omnidirectional ultra-wideband monopole antenna of claim 1, wherein widths of the second sub-radiating member and the third sub-radiating member are smaller than ¾ wavelength of operating frequencies.

15. The omnidirectional ultra-wideband monopole antenna of claim 1, wherein the first and second planes are parallel planes.

16. An omnidirectional ultra-wideband monopole antenna, comprising:

a ground plane;

a feeding member extending through the ground plane, for carrying a signal from a signal source; and a radiating member, connected to the feeding member and receiving said signal from the feeding member, the radiating member having a central section parallel to said ground plane and two arms respectively extending from the opposite side of the central section and upwardly opposite to the ground, wherein each of the two arms has an upper free end not connected to any other element, and the two arms reside entirely within a first and second plane, respectively.

17. The omnidirectional ultra-wideband monopole antenna of claim 16, wherein the central section has a feeding point provided for the feeding member to connect and transmit the signal.

18. The omnidirectional ultra-wideband monopole antenna of claim 17, wherein the feeding point is installed at about the center of the central section.

19. The omnidirectional ultra-wideband monopole antenna of claim 16, wherein an angle between the central section and each of the arms is the same and equal to about 90 degrees.

20. The omnidirectional ultra-wideband monopole antenna of claim 16, wherein each of the arms is of quadrilateral shape and the length ratio of two adjacent side edges of each arm is greater than 2.

21. The omnidirectional ultra-wideband monopole antenna of claim 16, wherein the upper free end is of round shape.

22. The omnidirectional ultra-wideband monopole antenna of claim 16, wherein the first and second planes are parallel planes.

* * * * *